US005979331A

United States Patent [19]

Casull

[11] Patent Number: 5,979,331

[45] Date of Patent: Nov. 9, 1999

[54] CARTRIDGE FOR A FIREARM

[76] Inventor: Richard J. Casull, P.O. Box 243, Freedom, Wyo. 83120

[21] Appl. No.: 08/683,078

[22] Filed: Jul. 16, 1996

[51] Int. Cl.[6] ..... F42B 5/26

[52] U.S. Cl. ..... 102/470; 102/464; 42/25

[58] Field of Search ..... 102/469, 470, 102/464, 465; 42/25

[56] References Cited

U.S. PATENT DOCUMENTS

| | | | |
|---|---|---|---|
| 16,797 | 3/1857 | Hicks | 42/25 |
| 125,803 | 4/1872 | Milbank . | |
| 151,121 | 5/1874 | Hart et al. | 42/25 |
| 674,751 | 5/1901 | Bailey . | |
| 830,510 | 9/1906 | Lehmann . | |
| 1,713,954 | 5/1929 | Destree . | |
| 2,083,665 | 6/1937 | Pihl et al. . | |
| 2,573,451 | 10/1951 | Keller et al. | 102/38 |
| 2,818,021 | 12/1957 | Boehm et al. | 102/469 |
| 3,060,855 | 10/1962 | Henning et al. | 102/38 |
| 3,609,904 | 10/1971 | Scanlon | 42/76 |
| 3,618,246 | 11/1971 | Woodring | 42/16 |
| 3,631,622 | 1/1972 | Walker et al. | 42/25 |
| 3,680,242 | 8/1972 | Wiese | 42/25 |
| 3,738,223 | 6/1973 | Post et al. | 89/26 |
| 4,149,465 | 4/1979 | Verkozen | 102/45 |
| 4,272,902 | 6/1981 | Waters | 42/25 |
| 4,395,838 | 8/1983 | Civolani | 42/25 |
| 4,646,458 | 3/1987 | Stevens | 42/46 |
| 4,653,210 | 3/1987 | Poff, Jr. | 42/16 |
| 4,676,017 | 6/1987 | Hurlemann et al. | 42/25 |
| 4,895,064 | 1/1990 | Marzocco | 89/196 |
| 5,024,016 | 6/1991 | Smith | 42/25 |
| 5,272,983 | 12/1993 | Sippel et al. | 102/469 |
| 5,345,854 | 9/1994 | Schieferle et al. | 42/25 |

FOREIGN PATENT DOCUMENTS

| | | | |
|---|---|---|---|
| 1963907 | 6/1971 | Germany | 102/469 |
| 29836 | of 1896 | United Kingdom . | |
| 2 024 383 | 1/1980 | United Kingdom . | |
| 2079906 | 1/1982 | United Kingdom | 42/25 |

*Primary Examiner*—Stephen M. Johnson
*Attorney, Agent, or Firm*—Pennie & Edmonds LLP

[57] ABSTRACT

A cartridge for a firearm includes a cavity at the rear end with an inwardly extending flange. The cartridge includes a cylindrical member having a first end for receiving a bullet and a second end defining a second end wall having an aperture. The second end of the cylindrical member includes a flange portion and defines a cavity with an inwardly extending flange around the circumference of an outer end of the cavity. The flange has an inwardly angled surface which is at an angle sufficient to allow an extractor member, associated with a firearm, to engage the cavity behind the flange.

20 Claims, 9 Drawing Sheets

CARTRIDGE FOR A FIREARM

FIELD OF THE INVENTION

This invention relates to a firearm and, in particular, to an extractor, a receiver, a chamber and a cartridge for a firearm. This invention also relates to a system for extracting a cartridge from a firearm and to a method of manufacturing a cartridge for use in a firearm.

BACKGROUND OF THE INVENTION

It is a continuing goal of firearm manufacturers to increase the performance level of their products. It is often a goal to increase the velocity of the bullet exiting the firearm.

A typical firearm includes a barrel, a receiver, and a breech block or bolt. The barrel is generally a tubular member out of which the bullet exits after firing. The receiver of the weapon is connected to the barrel and the ammunition is placed into an opening or chamber in the receiver prior to firing. The ammunition may be placed in the chamber either manually or automatically, with the use of a magazine. The ammunition is placed in the chamber of the receiver so that the bullet faces the entrance to the barrel. The rear end of the ammunition, which generally houses gun powder, faces the bolt or breech block. The bolt or breech block typically houses the firing pin which is used to ignite the primer in the ammunition. The primer then ignites the gun powder. The bolt or breech block is also used to close off the rear end of the ammunition so that when the ammunition is fired, the bullet goes out the barrel, not through the rear end of the firearm.

There are two types of ammunition which are commonly used, caseless cartridges and cartridges with cases. With both types of ammunition, the gun powder is usually ignited by a primer which is located on an outside surface of the ammunition. With rim-fired ammunition, the primer charge is located around the rim, or external edge, of the ammunition. With center-fire ammunition, the primer is located in the rear of the ammunition in the vicinity of the bolt.

With caseless ammunition, the projectile exits through the barrel of the gun so that after the ammunition is fired, nothing remains in the chamber of the receiver. With cartridges with cases, the projectile or bullet exits through the barrel and the empty casing remains in the receiver. In both cases, there is a need to extract the remaining ammunition from the receiver in order to fire another round of ammunition. With caseless ammunition, there is a possibility that the ammunition in the receiver chamber will misfire and will require manual removal. With cartridge cases, the empty casing must be removed before the next cartridge can enter the receiver chamber. Therefore, it is known to provide means for extracting both caseless ammunition which has misfired and empty casings from the chamber of the receiver of the weapon. With automatic or semi-automatic weapons, the extractor works in combination with an ejector to automatically eject the casing from the chamber. An ejector arm in the receiver strikes the case from the side, ejecting it out a port in the receiver.

There are several ways to extract casings and misfired ammunition from the chamber of the receiver. The first involves the use of external extractors and the second involves the use of internal extractors.

With external extractors, the cartridge casing or caseless cartridge typically includes a rim or exterior groove on the cartridge for gripping by an extractor. The rim or groove may also be used for positioning and maintaining the cartridge in the chamber. For proper extractor functioning, the rim or groove must be accessible from the face of the bolt to enable the extractor to grip the rim or groove. When the extractor is positioned behind the rim or within the groove on the cartridge and the bolt is moved rearward within the receiver of the gun, the cartridge may be removed from the chamber either manually or automatically.

One problem which is associated with cartridges used with external extractors is that the rim or groove may cause a weakened or defective cartridge to fracture along the rim or groove during firing. When the cartridge fractures during firing, the cartridge explodes or blows back into the weapon receiver. This may result in damage to the weapon and injury to the user. The likelihood of blow-back is more common with reloaded ammunition where firings have weakened the cartridge. In order to avoid damage to the weapon and the user from blowback, conventional weapons with external extraction have bolt ends which have a diameter greater than the cartridge case head at the rear of the cartridge so that the extractor can grab the external rim for extraction. Receivers for conventional weapons must be sized to accommodate these bolt ends, which results in heavy bolts with proportionally larger receivers. The combination results in a heavy weapon. Cartridge diameter along with bullet weight has, therefore, been an important factor in the design of firearms, which for lighter weapons means smaller diameter cartridges.

In conflict with the desire to keep weight down has been the desire to increase bullet velocity. A shorter, wider cartridge case is more efficient than a longer, narrower cartridge case of the same powder capacity. A shorter, wider cartridge case has a larger powder surface area to burn. A longer, narrower cartridge case, at the moment of ignition, requires greater energy to push the unburned powder weight along with the bullet weight through the throat of the barrel. A shorter, wider case reduces the height of the column of powder that is pushed with the bullet. The result, with the shorter wider casing, is more efficient energy utilization and higher bullet velocity from the same weight of powder.

A greater powder burn area and a shorter powder column also provides for a faster, more complete burn, driving a greater burn efficiency that also translates to an increase in gas production and a greater bullet velocity. In earlier cartridges, greater powder charges have been used to produce higher bullet velocities, but this creates a pressure condition in the cartridge case which can result in blowback.

Therefore, it is desirable to provide a weapon with a shorter, wider cartridge case, but without increasing the size and weight of the weapon.

U.S. Pat. No. 29,836 to Maxim, U.S. Pat. No. 4,676,017 to Hurlemann et al., and U.S. Pat. No. 5,024,016 to Smith describe external extractors. U.S. Pat. Nos. 125,830 to Milbank, 674,751 to Bailey, 2,083,665 to Pihl et al., 2,573,451 to Keller et al., and 4,149,465 to Verkozen describe ammunition cartridges which incorporate an external rim or groove for external extraction.

With internal extractors, the cartridge casing or caseless cartridge typically includes a rim or groove on the interior of the end of the cartridge for gripping by an internal extractor. With internal extractors, the end of the extractor and bolt end may be inserted into a cavity inside the cartridge so that the bolt end fits closely in the cavity of the cartridge. This may reduce the likelihood of blowback.

U.S. Pat. No. 1,713,954 to Destree describes an internal extractor for use with a cartridge having an inwardly extending flange at the bolt end. The extractor in this invention is part of the firing pin so that the extractor/firing pin strikes the primer in a cavity of the cartridge. The extractor/firing pin is biased upwardly and the extractor end of the firing pin has an angled edge. When the extractor/firing pin is being inserted into the cartridge, a sloped surface on an upper edge of the extractor/firing pin engages the flange on the cartridge against the upward force of a spring which allows the extractor/firing pin to enter the cavity of the cartridge. Once the extractor/firing pin has passed by the flange, the spring forces the extractor/firing pin upward to engage the cavity behind the flange so that the casing may be removed from the chamber after firing.

U.S. Pat. No. 3,680,242 to Wiese describes an internal extractor which is pivoted upward to engage a flange formed on the rear end of the projectile when the firing pin moves forward to fire the charge.

U.S. Pat. No. 4,395,838 to Civolani describes an ejector for use with caseless cartridges in conjunction with a cartridge design. The ejector engages an interior surface of the cartridge to hold the cartridge in position when the cartridge has not fired but allows the cartridge to exit the barrel when the charge in the cartridge is fired.

U.S. Pat. No. 4,895,064 to Marzocco describes an internal extractor in combination with a cartridge where the extractor extends from the face of the bolt to engage an inner chamber of a caseless cartridge.

U.S. Pat. No. 3,618,246 to Woodring discloses a caseless cartridge having an inwardly extending flange at one end of the cartridge for engaging an extractor.

Among other things, it is desirable to provide an improved extractor system wherein the end of the bolt and the extractor effectively enter the cavity of the cartridge. It is, likewise, preferred to provide a cartridge which is the same diameter as the bolt. It is also desirable to provide an extractor which exerts a positive rotational force on the cartridge to more reliably remove the cartridge from the chamber. In addition, it is desirable to provide a method for manufacturing a cartridge for use with internal extraction. Further, it is desirable to provide a reinforced receiver for mating with the barrel which reduces the amount of machining necessary to provide a precision fit between the barrel and receiver and to further reinforce the chamber of the firearm.

SUMMARY OF THE INVENTION

One aspect of the present invention relates to a system for extracting a cartridge or cartridge case from a firearm having a barrel, a receiver for connecting to the barrel, and a chamber defined within the receiver at an end of the barrel. The system includes a bolt member, an extractor member, a spring member, and a cartridge or cartridge case.

The bolt member is positioned within the receiver at the end of the chamber which is opposite the barrel end. The bolt member has a bolt end with a circumferential surface and a face. A longitudinal groove is disposed on the circumferential surface which extends longitudinally from the face of the bolt member and along the circumferential surface.

The extractor member is positioned in the longitudinal groove and has a first and second end. An outwardly extending lip portion is positioned at the first end of the groove. The extractor member is pivotal in the groove about a first pivot point.

The spring member is associated with the second end of the extractor member and connected to the bolt end. The spring member engages the extractor member to hold it in the groove while allowing the extractor member to pivot.

The cartridge case has a first bullet end and a second end which includes a cavity with an inwardly extending flange at an outer edge of the cavity. The extractor member pivots radially against the force of the spring member about the first pivot point in order for the extractor member and bolt end to enter the cavity of the cartridge case. When the extractor member and bolt end enter the cavity, the lip portion of the extractor engages the cavity behind the flange in order to aid in the withdrawal of the cartridge case from the chamber.

The lip portion of the extractor member may be positioned on the upper surface of the extractor member. The first end of the lip portion may be substantially aligned with the face of the bolt end. The lip portion may have a convex outward face which extends from the first end of the extractor member to a trailing edge of the lip portion. In the alternative, the lip portion may have an angled surface which extends from the first end of the extractor member to a trailing edge of the lip portion.

The flange at the second end of the cartridge case may be angled on an outward facing surface for engagement with the bolt end and extractor member. In the alternative, the flange may have a curved outwardly facing surface.

The extractor member advantageously has a lower surface which extends longitudinally within the groove and includes a first and a second portion. The first and second portions connect to define the first pivot point where the portions meet. The first portion may be at an angle ranging from about 185° to 210° relative to the second portion. The second portion may be parallel to the upper surface of the extractor and the first portion may be at an oblique angle relative to the second portion.

The extractor member may also include a second pivot point which is in the vicinity of the upper surface of extractor member. When the bolt member is moved longitudinally to extract the cartridge case from the chamber, the extractor member pivots about the second pivot point and exerts an extraction force on the flange of the cartridge case which is sufficient to move it longitudinally within the chamber.

In another embodiment of the present invention, the extractor member may be held in position within the longitudinal groove by a ring member positioned around the circumference of the bolt end. The ring member may be positioned in a slot defined upon the upper surface of the extractor member and the ring member defines the location of the second pivot point. The ring member may be positioned in a circumferential groove which extends around at least a portion of the circumference of the bolt end. The ring member may extend substantially 360° around the circumference of the bolt end or may extend less than 360° around the circumference of the bolt end.

In another embodiment of the present invention, the extractor member includes a pair of trunnions which extend oppositely and transversely on the upper surface of the extractor member. The trunnions define the location of the second pivot point. The longitudinal groove includes a transverse portion for pivotally positioning the trunnions therein. The trunnions are substantially centrally located on the upper surface of the extractor member and are flush with the upper surface. The trunnions may have a trapezoidal cross-section with a chamfered forward upper edge defining the location of the second pivot point. The second pivot point may be radially spaced relative to a trailing edge of the lip portion.

In another embodiment of the present invention, the extractor member includes a radial bore which extends therethrough. A pin member is connected to the bolt member within the longitudinal groove at a lower end of the pin member and the pin member extends into the bore. The radial bore may have a greater diameter at the lower surface of the extractor member than at the upper surface so that the extractor member can pivot at the first pivot point. The radial bore may be substantially the same diameter as the pin member at the point where the pin member meets the radial bore so as to define the second pivot point.

In another embodiment of the present invention, the system for extracting a cartridge from a firearm having a chamber, a barrel and a receiver includes a bolt, an extractor, and a cartridge case. The bolt has a bolt end with an outer circumferential surface and a face. The bolt end face has a chamfered portion extending circumferentially around at least part of the bolt end.

The extractor is received on the bolt end and has an outwardly extending lip, one end of which is substantially aligned with the face of the bolt end. The extractor is positioned substantially opposite the chamfered portion on the bolt end face.

The cartridge case has a first bullet end and a second end with a cavity. An inwardly extending flange is located at an outer edge of the cavity. The chamfered surface on the bolt and face allows the lip of the extractor to enter the cavity in the cartridge case. As the bolt end face moves inwardly into the cavity and the chamfer dissipates, the lip moves behind the flange to engage the cavity behind the flange.

The bolt end may include a recess defined adjacent the lip of the extractor. This recess allows the flange of the cartridge to move downward into the recess during extraction so that when the casing is being extracted and ejected from the chamber, the cartridge case flange may rotate into the recess to allow the bolt end to exit the cavity.

In another embodiment of the present invention, a system for extracting a cartridge from a firearm having a chamber, a barrel, and a receiver includes a bolt, an extractor, and a cartridge. The bolt has a bolt end with an outer circumferential surface and a face.

The extractor is received in the bolt end and has an outwardly extending lip which is substantially aligned with the face of the bolt end. The cartridge has a first bullet end and a second end with an inwardly extending flange. The second end also has a cavity adjacent the flange between the first and second ends. The inwardly extending flange has an angled portion for engaging the bolt end. As the bolt end face enters the cavity, the angled surface allows the lip to enter the cavity and engage the flange. The angled surface also allows the cartridge case to rotate off of the bolt end in order to be ejected.

The bolt end may include a recess which is defined adjacent the lip. The recess allows the flange of the cartridge to move downward into the recess during extraction so that when the cartridge is being extracted and ejected, the cartridge rotates to allow the bolt end to exit the cavity.

In another aspect of the present invention, a cartridge for a firearm having a barrel, a bolt with a bolt end and extractor, and a chamber includes a cylindrical member, a male cylindrical insert, and a female cylindrical insert.

The cylindrical member has a first end and a second end. The first end is for receiving a bullet. The second end defines a second end wall which has a first aperture. The member is dimensioned and configured for positioning within the chamber of the firearm.

The male cylindrical insert is for positioning within the member. The male insert has a first portion for seating against an internal side of the second end wall and a cylindrical extension for positioning in and extending through the first aperture. The extension defines a second aperture therethrough.

The female cylindrical insert has a first end and a second end. The first end defines a first end wall with a third aperture for mating with the extension of the male insert and for joining with an external side of the second end wall. The female insert second end has an opening for receiving the bolt end and the extractor.

The cartridge may also include a primer cavity for receiving a primer defined in the extension of the male insert. The primer cavity is located at an end of the second aperture.

An internal chamber may be defined between the male insert and the first end of the cartridge for receiving a column of gun powder. The internal chamber communicates with the primer cavity via the second aperture. When the primer is ignited, a charge travels through the second aperture to ignite the gun powder in the internal chamber.

The cylindrical female insert may include a lip positioned adjacent the opening and a depression located between the lip and the first end wall. The lip may be an inwardly extending flange which extends around the entire circumference of the opening The flange may have at least one angled or curved edge. The angled or curved edge may be located on a surface of the flange which faces away from the opening.

The extension of the male insert includes a face which may substantially align with an inner side of the first end wall of the second insert.

In another embodiment of the present invention, a cartridge for a firearm having a barrel, a bolt with a bolt end and an extractor, and a chamber between the barrel and the bolt, includes a cylindrical member and an insert.

The cylindrical member has a first end for receiving a bullet and a second end defining a second end wall having a first aperture. The insert has a first end wall with a as second aperture for engaging the second end wall of the cylindrical member. The insert has a second end which defines a cavity with an inwardly extending flange. The flange is positioned around the circumference of an outwardly extending end of the cavity and has at least a portion with an inwardly angled surface. When the bolt end and the extractor enter the cavity, the angled surface is at an angle sufficient to allow the extractor lip to engage the cavity behind the flange.

The cylindrical member may include a member extension which extends outward from the second end wall. The first aperture extends through the extension so that the insert mates with the member extension to connect the cylindrical member to the insert. The member extension may include a primer cavity which is positioned at one end of the first aperture for receiving a primer.

The cartridge may also include an internal chamber defined between the second end wall and the first end of the cylindrical member for receiving a column of gun powder. The internal chamber communicates with the primer cavity via the first aperture. When the primer is ignited, a charge travels through the first aperture to ignite the gun powder in the internal chamber.

The cartridge may also include a flash tube which has a first and second end. A flange extends outwardly at the second end of the flash tube. The second end of the flash tube is configured and dimensioned for positioning within the primer cavity. The first end of the flash tube extends through the first aperture into the internal chamber.

In another embodiment, the cartridge insert may include an insert extension extending outwardly from the first end wall with a second aperture extending therethrough. The insert extension mates with the first aperture of the cylindrical member.

The insert extension may include a primer cavity. The cartridge may also include an internal chamber defined between the second end wall and the first end of the cylindrical member for receiving a column of gun powder. The cartridge may also include a flash tube.

In yet another aspect of the present invention, a method of manufacturing a cartridge case includes forming a cylindrical cartridge case section having a first end for receiving a bullet and a second end defining a wall with a first aperture. The method also includes pressing a male insert into the cylindrical cartridge case section so that an extension of the male insert extends through and past an end of the first aperture The male insert includes a second aperture which is defined through the extension. The method also includes pressing a female insert onto the extension of the male insert which extends past the first aperture to mate the cartridge case section, the male insert, and the female insert together.

The pressing together of the female insert to the male insert results in a flush engagement between the inserts. The method may also include forming a bullet mounting end on the first end of the cartridge case by necking the cartridge case inward, disposing gun powder in the cartridge case, and mounting a bullet in the first end of the cartridge case.

The method may also include disposing a primer in a cavity formed in the extension of the male insert adjacent an end of the second aperture, pressing a flash tube insert into the second aperture of the male insert, and brazing the case cartridge section to the male and female inserts.

In another aspect of the present invention, a method of manufacturing a cartridge case includes seating an open end of a tube having an open end and a closed end into a female mandrel opening. The closed end of the tube has an outwardly projecting flange that extends beyond the female mandrel opening. Another step includes fitting an open end of a male mandrel against the closed end of the tube and pressing the male and female mandrels toward each other, in steps, to force the flange into the female mandrel opening to collapse the flange against the male mandrel so that the flange forms a cylinder which is substantially the same diameter as the tube. Another step includes forming a groove around an inner surface of the cylinder so that a lip is formed at an open end of the cylinder and the groove is positioned next to the lip.

The method may also include forming a primer cavity in the closed end of the tube for receiving a primer. The primer cavity includes an aperture for communicating with an interior portion of the tube.

The method may also include forming an inwardly necked section in the open end of the tube for receiving a bullet and fitting a flash tube into the primer cavity and through the aperture so that the flash tube extends into the interior portion of the tube.

In another aspect of the present invention, a firearm chamber for receiving a cartridge includes a cylindrical barrel, a cylindrical receiver, and a cylindrical insert. The barrel has a bore extending longitudinally from a first end to a second end and an outer circumference. The second end has an angled surface portion which extends inwardly towards the bore. The cylindrical receiver is for associating with the second end of the barrel. The insert is associated with an inner surface of the receiver. The insert has a forward angled portion which is complementary to the inwardly angled surface of the barrel for mating with the barrel. When the barrel becomes associated with the receiver, the angled portions of the insert and barrel meet to form a substantially gapless association along at least a portion of the angled surfaces. The chamber is formed between a part of the angled portion of the barrel, an inner surface of the insert, and an inner surface of the receiver.

The outer surface of the barrel may include a plurality of connecting means disposed near the second end for connecting to a plurality of connecting means disposed on an inner surface of the receiver. The connecting means may be threads and the barrel is screwed into the receiver.

The angled surface of the barrel may be substantially at the same angle as a neck of the cartridge. The insert may be welded to the receiver.

BRIEF DESCRIPTION OF THE DRAWINGS

Preferred features of the present invention are disclosed in the accompanying drawings, wherein similar reference characters denote similar elements throughout the several views, and wherein.

DETAILED DESCRIPTION OF THE DRAWINGS

Figure 1:
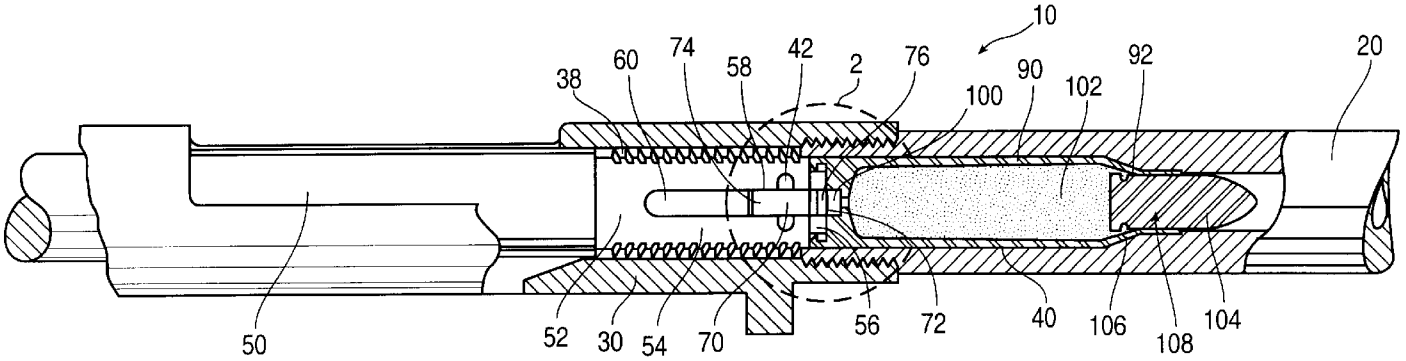
FIG. 1 is a cross-sectional view of a portion of a firearm which shows the extractor of the present invention installed within a cavity in a cartridge.

Various aspects of the present invention are shown in FIG. 1, which depicts an internal cross-section of a firearm 10. A typical firearm 10 includes a barrel 20, a receiver 30, and a chamber 40 defined within the receiver 30. The chamber 40 is defined at one end by the barrel 20 and at the other end by the bolt 50. The bolt 50 is movable within the receiver 30 to hold cartridge 90 in position in the chamber 40 for firing and for extracting spent casings 90 or misfired caseless cartridges 90 from the chamber 40. A typical firearm 10, in addition to an extractor 70, includes an ejector (not shown) The extractor 70 moves the cartridge 90 or casing 90 within the chamber 40 to the ejection position and an ejector arm in the receiver strikes the cartridge case from the side to eject the cartridge or casing from the chamber 40 through a port in the receiver to allow for either automatic or manual reloading of the chamber 40. Automatic reloading may be accomplished with the use of a magazine (not shown).

While the present invention may be used with either a cartridge casing or with a caseless cartridge, in order to avoid repetitiveness, hereinafter the discussion will refer only to cartridge casings. However, it is anticipated and expected that the present invention could be used with a caseless cartridge as well.

Figure 2:
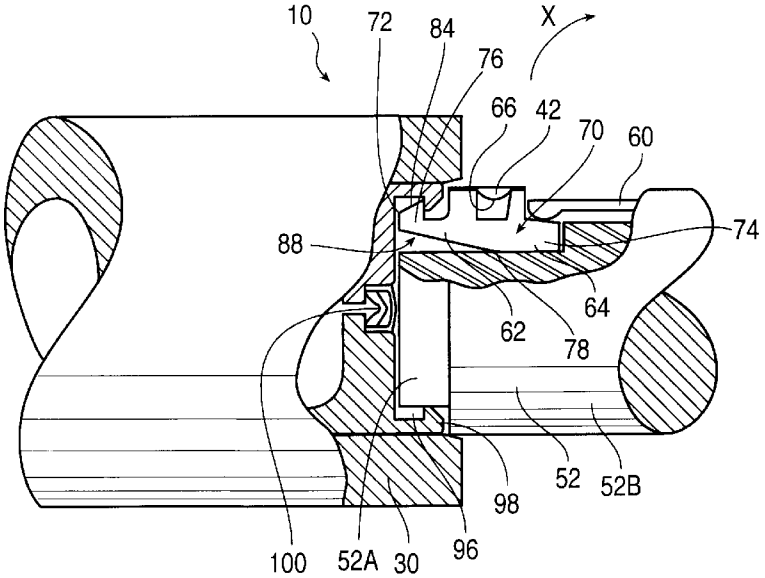
FIG. 2 is a partial cross-sectional view of encircled portion 2 of FIG. 1.

FIGS. 1 and 2 show a cartridge 90 positioned in the chamber 40 of the firearm 10. The cartridge 90 has a bullet end 108 with a necked down portion 106 for holding a bullet 104 at one end and a cavity 96 defined at the other end. The cavity 96 includes a flange 98 which extends inwardly around the inside circumference of the cavity 96 for engagement with an extractor 70. As shown in FIGS. 1 and 2, the extractor 70 is positioned in a longitudinal groove 58 on the bolt end 52. The extractor 70 is held within the groove by a spring 60 which is attached in a conventional manner to the bolt end 52. The spring 60 holds the extractor 70 at a second end 74 of the extractor 70. The first end 72 of the extractor 70 includes an outwardly facing lip 76. The lip 76 has an outward face 84 which may be curved or angled (as shown in FIG. 2). The extractor lip 76 is for engaging behind the flange 98 within the cavity 96 of the cartridge 90.

The cartridge 90 includes a smooth outer surface, without grooves or bends, which could create points of weakness that could blowout when the cartridge is fired.

As shown in FIG. 1, the bolt 50 is received in the receiver 30 and is preferably associated with the receiver 30 by connecting means 38, such as threads or bayonet mounts. The threads or bayonet mounts may be disposed on an outer surface of the bolt 50 and on an inner surface of the receiver 30 for proper mating. The bolt 50 may be rotated and moved forward and backward within the receiver 30 by the use of electronic means or an external source (not shown). The bolt 50 shown is the end of a conventional weapon bolt, which can be a bolt action rifle. It should be understood, however, that the cartridge 90 and extractor 70 is not to be limited for use in bolt action rifles and may be used in other firearms.

Referring to FIG. 2, the bolt end 52 has two portions 52A, 52B, which are stepped relative to each other. Bolt end portion 52A includes bolt end face 56. Bolt end portion 52A fits within the cartridge case cavity 96 and fits closely against the inner wall of the cavity 96. Bolt end portion 52B has a larger diameter than portion 52A and has about the same diameter as the cartridge case 90. Bolt end portion 52B seats closely adjacent the rear end of the cartridge 90. With the bolt end face 56 and the bolt end 52 seated in the chamber 40 and in the cavity 96, a gas flow cannot pass to the receiver 30 even if the case 90 ruptures. Advantageously, a bolt which is the same diameter as the cartridge case can be used with the present invention. Accordingly, the cartridge 90 can be safely used with a greater powder charge than has been possible with earlier cartridges of the same caliber, which required a larger diameter bolt than the diameter of the cartridge. A greater powder change results in a greater muzzle velocity than could be achieved with earlier cartridges of the same diameter.

The cartridge 90 of the present invention may have a greater case diameter without an increase in receiver and barrel weight over like caliber weapons. Advantageously, the use of a wider diameter cartridge allows for utilization of a shorter column of gun powder which has a greater surface area of powder that is burned on ignition of the primer. A shorter powder height decreases the burn time compared to like caliber charges and results in more of the powder being burned and, therefore, less of the powder being ejected with the bullet. A shorter, wider cartridge case is more energy efficient and creates a higher bullet velocity from the same weight of powder. Therefore, the present invention allows for the use of a wider diameter cartridge which either can hold a larger charge than similar caliber weapons or, without a larger charge, produces a faster bullet velocity than similar caliber cartridges due to the shorter, wider charge.

Figure 3:
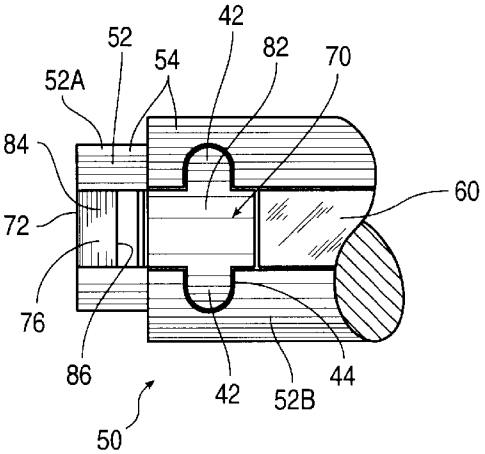
FIG. 3 is an elevational view of one embodiment of the extractor of the present invention, as shown in FIG. 2, with the extractor installed on a bolt end.

As shown in FIGS. 2 and 3, since the extraction cavity is formed on the inside of the cartridge case, an internal extractor is used with the present invention. Extractor 70 is preferably seated in a longitudinal groove 58 defined in the bolt end 52 extending from the bolt end face 56 and along the outer circumferential surface 54 of the bolt end 52. A first end 72 of the extractor 70 has a lip 76 and is preferably aligned with the bolt end face 56. The second end 74 of the extractor is held in position in the groove 58 by a spring 60 which extends over the groove 58 from the surface of bolt end portion 52B.

As shown in FIGS. 2–6, the extractor 70 has an upper surface 82 and a lower surface 88. The lower surface 88 has a first portion 62 and a second portion 64. The first portion 62 is preferably at an angle relative to the second portion 64 to define a first pivot point 78 where the two portions meet.

The second portion 64 is preferably parallel to the upper surface 82 of the extractor 70.

In operation, the first pivot point 78 aids the extractor 70 in passing by the flange 98 to enter the cavity 96 of the cartridge behind the flange 98. As the extractor 70 and bolt end face 56 move into the cavity 96, the angled or curved surface on the lip 76 comes into contact with the flange 98. As shown in FIG. 2, in addition to the extractor lip 76 having an angled or curved outer face 84, the flange 98 may also have a curved or angled outer face. It is not necessary that both the flange 98 and the lip 76 have curved or angled surfaces, as the invention will operate properly with one of the surfaces being angled or curved.

As the lip 76 engages the flange 98, the lip 76 is forced downward to avoid the flange 98. As the lip 76 is forced downward, the extractor 70 pivots about the first pivot point 78 against the force of the spring 60. In this way, the extractor lip 76 is allowed to pass by the flange 98. Once the lip 76 passes by the flange 98, it enters the cavity 96 behind the flange 98, as shown in FIG. 2, and the force of the spring 60 returns the extractor 70 to its original position. In this position, the lip 76 is positioned behind the flange 98 for proper extraction.

It is desirable that the flange 98 extend around the entire circumference of the cavity 96 so that the extractor 70 can be positioned at any point within the cavity 96 of the cartridge for proper extraction. While the cavity 96 is shown behind the flange 98, it should also be noted that a depression or similar indentation would also work effectively.

In one embodiment of the present invention, the extractor 70 includes a pair of trunnions 42 which extend transversely and oppositely from the upper surface 82 of the extractor, as shown in FIGS. 2 and 3. The longitudinal groove 58 in the bolt end 52 preferably includes transverse portions 44 which extend from the sides of the groove 58 for positioning the trunnions 42 therein.

Advantageously, the trunnions 42 allow the extractor 70 to rotate at a second pivot point 66 defined at the position of the trunnions 42. The second pivot point 66 is functional when the extractor 70 is used to extract the casing from the chamber 40. After the lip 76 is engaged within the cavity 96, the extractor 70 exerts a positive rotational force in direction X, shown in FIG. 2, to firmly grasp the cartridge to properly extract it from the chamber 40. The extractor 70, around the second pivot point 66, applies a force in direction X which is sufficient to extract the cartridge from the chamber 40. This rotational force in the X direction also helps to rotate the cartridge upward during ejection, when the upward movement is not blocked by the receiver 30.

As shown in FIG. 3, the extractor upper surface 82 is preferably flush with the outer circumference of the bolt end 52A so that only the lip 76 protrudes beyond the surface of the bolt end 52A. It is preferable that the bolt end 52 is substantially the same diameter as the cavity 96 entrance and that the extractor lip 76 extends beyond the diameter of the cavity 96 entrance. The rotation of the extractor 70 on the first pivot point 78 allows the bolt end 52 and extractor 70 to enter the cavity 96. After the lip 76 has entered the cavity 96, the extractor lip 76 extends past the diameter of the bolt end 52 to be held within the cavity 96 behind flange 98 for extraction.

Figure 4:
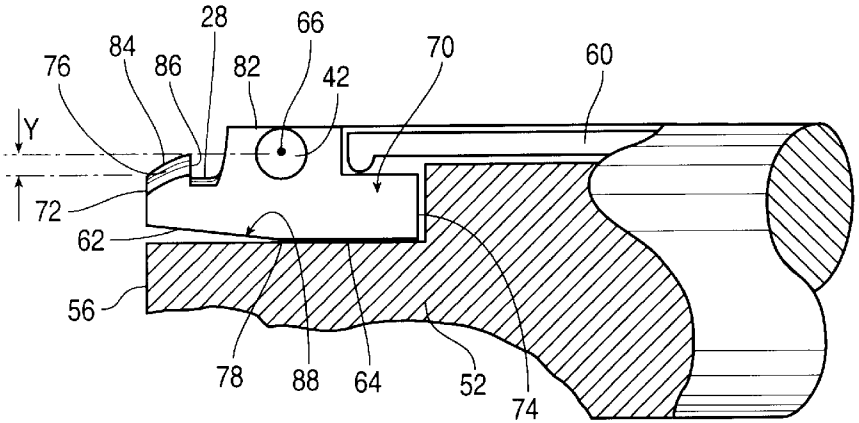
FIG. 4 is a cross-sectional view of another embodiment of the extractor of the present invention installed on a bolt end.
Figure 6:
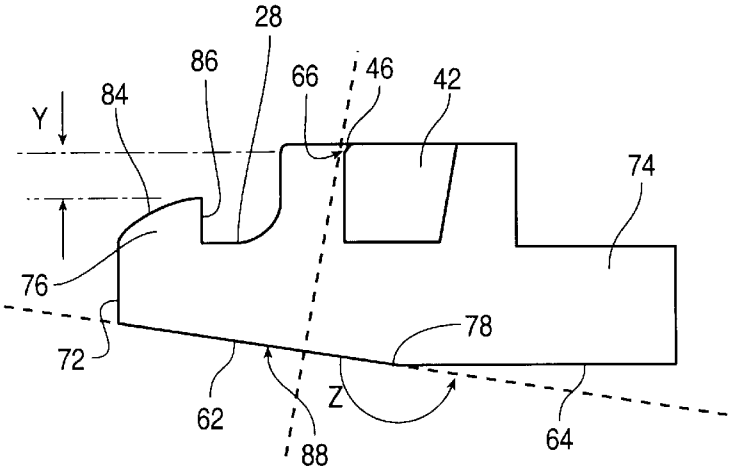
FIG. 6 is a side view of another embodiment of the extractor of the present invention.

As shown more clearly in FIGS. 4 and 6, the lip 76 of the extractor 70 has a trailing edge 86 which is displaced radially relative to the second pivot point 66. The radial displacement is shown by distance Y. Advantageously, this displacement or distance is formed between the trailing edge of the lip 76 and the position of the second pivot point 66 so that, during extraction, the extractor 70 exerts a positive rotational force in direction X to exert a greater than normal force on the flange 98 and cavity 96 of the cartridge to more efficiently and effectively remove the casing from the chamber 40.

Figure 5:
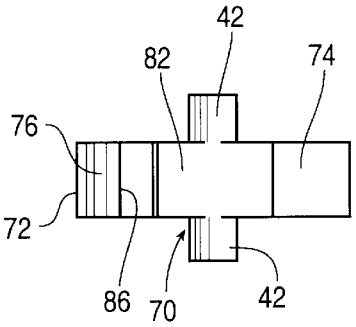
FIG. 5 is an elevational view of the extractor shown in FIG. 4.

FIGS. 4 and 5 show another embodiment of the extractor 70 of the present invention. In this case, the trunnions 42 are in the form of cylinders which extend transversely from the sides of the extractor 70. The rotational point of the trunnions 42 defines the second pivot point 66. As is shown in FIG. 4, distance Y is defined between the trailing edge of the lip 76 and the second pivot point 66. A notch 28 is disposed between the trailing edge of the lip 76 and the trunnion 42. When the extractor 70 is inserted into the cavity 96 of the cartridge so that the lip 76 passes by the flange 98 and into the cavity 96, the flange 98 is positioned within the notch 28.

As shown in FIGS. 4 and 5, the extractor 70 of this embodiment also includes a lower surface 88 with a first 62 and second portion 64.

As is shown in FIG. 4, the extractor 70 fits within the longitudinal groove 58 so that at the end of the groove, the second end 74 of the extractor abuts against the end of the groove. The first end of the extractor preferably substantially aligns with the face 56 of the bolt end 52A. This is advantageous because a greater portion of the bolt end 52A may enter the cartridge cavity 96 if the extractor 70 aligns within the bolt end face 56. By having a greater portion of the bolt end face 56 enter the cavity 96, the risk of damage caused by blowback may be lessened since the bolt end 52A provides reinforcement for the structure of the cartridge 90.

Another embodiment of the extractor 70 of the present invention is shown in FIG. 6. In this case, the trunnions 42 are a trapezoidal shape which has an upper chamfered edge 46 which provides the location of the second pivot point 66. In FIGS. 2 through 5, extractors were shown which had the first pivot point 78 substantially radially aligned with the second pivot point 66. The extractor 70 shown in FIG. 6 incorporates an extractor 70 which has the second pivot point 66 in front of the first pivot point 78. In addition, the second pivot point 66 is positioned along the upper surface 82 of the extractor. By positioning the second pivot point 66 along the upper surface 82, the radial distance Y between the trailing edge 86 of the lip 76 and the second pivot point 66 is increased, thereby increasing the amount of engagement or extraction force exerted on the flange by the extractor. It is preferable to have a larger radial distance Y in order to exert a greater positive rotational extraction force on the extractor 70.

As is also shown in FIG. 6, the first portion 62 of the lower surface 88 of the extractor 70 is at an angle relative to the second portion 64 of the lower surface 88. The second portion 64 is preferably parallel to the upper surface 82 of the extractor, but this is not necessary. The first portion 62 is preferably at an obtuse angle Z relative to the second portion 64. Angle Z is preferably in the range of about 185° to 210°. Angle Z is most preferably about 192°.

Figure 7:
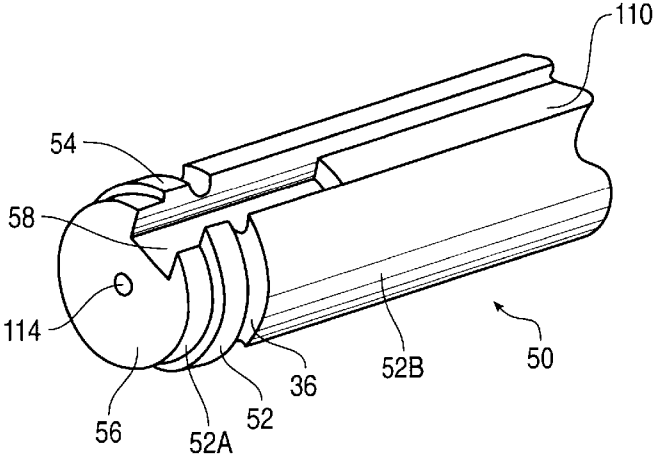
FIG. 7 is a perspective view of the bolt end of another embodiment of the present invention showing the groove for installing the extractor therein.

FIGS. 7 to 10 show an alternative embodiment of the extractor 70 and bolt end 52 of the present invention. FIG. 7 shows the bolt 50, the bolt end 52, and the face of the bolt end 56. A longitudinal groove 58 is disposed in the bolt end 52 which extends from the face 56 along the outer circumferential surface of the bolt end 52. An extension groove 110 of the longitudinal groove 58 is positioned on the outer surface of the bolt end in alignment with the longitudinal groove 58. The extension groove is used for seating the spring 60 therein. The spring 60 is preferably a leaf spring which is cantilevered over the edge of the extractor 70.

Figure 8:
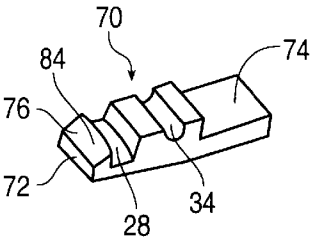
FIG. 8 is a perspective view of another embodiment of the extractor of the present invention for use with the bolt end shown in FIG. 7.

FIG. 8 shows an alternative embodiment of the extractor 70. The extractor 70 has a first end 72 and a second end 74. At the first end, a lip 76 extends outwardly and preferably has a curved or angled outer face 84. A depression 28 is located behind the lip 76 for positioning the flange 98 of the cartridge therein when the extractor 70 and bolt end 52 are inserted into the cavity 96.

The second end 74 of the extractor 70 is configured and dimensioned for accepting the spring 60. The upper surface 82 of the extractor includes a substantially centrally located slot 34. The extractor is sized for fitting within the longitudinal groove 58 so that the first end 72 of the extractor is substantially aligned with the face 56 of the bolt end 52.

Figure 9:
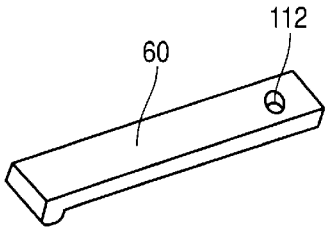
FIG. 9 is a perspective view of the spring used with the extractor of the present invention for installation on the bolt end.
Figure 10:
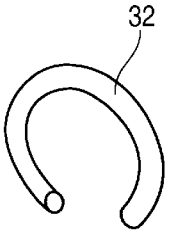
FIG. 10 is a perspective view of a ring utilized to hold the extractor, shown in FIG. 8, in position on the bolt end, shown in FIG. 7.

FIGS. 9 and 10 show the spring 60 and ring 32, respectively, of this embodiment. The spring 60 is positioned in the extension groove 110 and extends over the second end 74 of the extractor 70 to normally hold the extractor 70 in a non-pivoted position. The spring 60 may be attached to the bolt 50 by a screw or connector (not shown) through opening 112. Ring 32 is dimensioned and configured for positioning within the slot 34 defined on the upper surface 82 of extractor 70. The ring 32 fits around the bolt end 52 to hold the extractor 70 in position. The ring is preferably positioned in a circumferential groove 36, around the circumference of the bolt end 52 as well as in the slot 34 in the extractor.

The ring 32 allows the extractor 70 to pivot upon the first pivot point 78 during entry into the cavity 96. The ring also defines the location of the second pivot point 66 which is positioned along the forward edge of the ring at the top of the ring in the slot. The ring may extend 360° or less around the circumference of the bolt end 52. If the ring extends less than 360° around the surface, the groove for the ring is preferably less than 360° around the circumference in order to avoid the possibility that the ring rotates out of position for holding the extractor 70.

The bolt end 52 also includes an opening 114 for a firing pin which is shown in FIG. 7 on the face 56 of the bolt end 52. The firing pin (not shown) exits the bolt 50 through the opening 114 to strike the primer 100 in a cartridge 90 to ignite the gun powder 102 in the ammunition.

Figure 11:
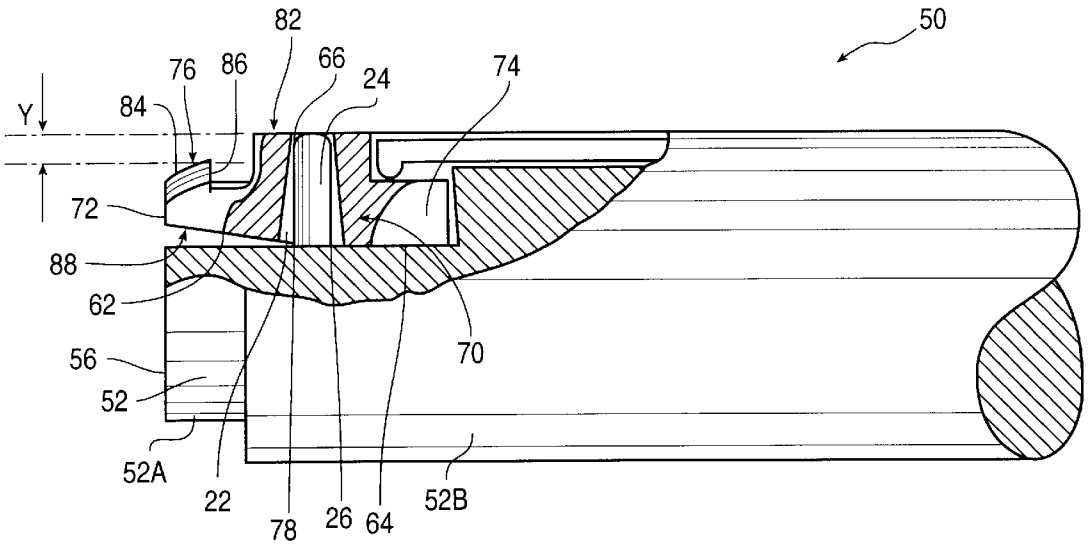
FIG. 11 is a partial cross-sectional view of another embodiment of the extractor of the present invention installed on the bolt end.

FIG. 11 shows yet another embodiment of the extractor 70 of the present invention. In this embodiment, the extractor 70 is positioned in the longitudinal groove 58 and the spring 60 holds the second end 74 of the extractor in the non-pivoted position. The first end 72 of the extractor includes an outwardly facing lip 76 and the first end 72 is preferably substantially aligned with the face 56 of the bolt end 52.

The lower surface 88 of the extractor includes a first portion 62 at an angle relative to a second portion 64. The first pivot point 78 is defined where the two portions meet. The second portion 64 is preferably parallel to the upper surface 82, but this is not necessary.

The extractor 70 of FIG. 11 includes a radial bore 22 with a pin 24 extending from the bottom of the longitudinal groove 58 radially to the upper surface 82 of the extractor 70 through the bore 22. The pin 24 is preferably a constant diameter. The bore 22 is preferably tapered and has a larger diameter at the lower surface 88 of the extractor than at the upper surface 82. The bore 22 is preferably about the same diameter as the pin 24 at the upper surface 82 of the extractor so that the pin 24 fits snugly, but pivotably, in the bore 22 at the upper surface 82. The second pivot point 66 is defined along the upper surface 82 where the pin 24 meets the bore 22. Advantageously, the tapered bore 22 allows the extractor 70 to pivot upon the first pivot point 78 during entry of the extractor into the cartridge cavity 96. In addition, the trailing edge of the lip 76 is preferably radially spaced by distance Y relative to the second pivot point 66.

Figure 13:
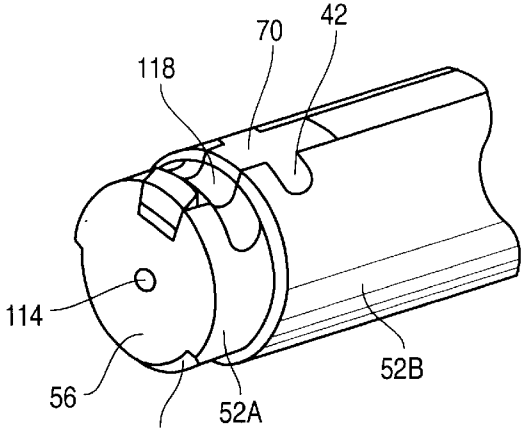
FIG. 13 is a perspective view of the bolt end extractor shown in FIG. 12.
Figure 12:
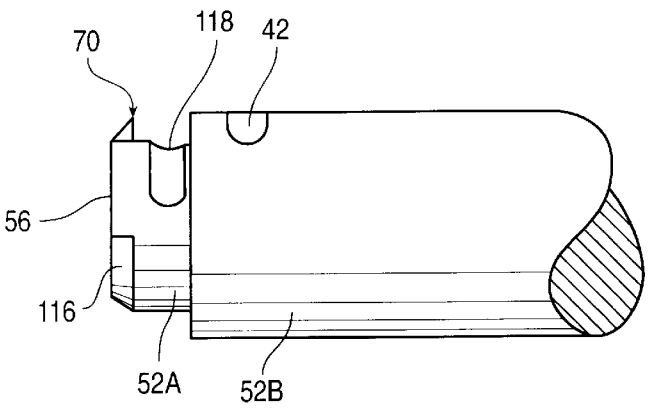
FIG. 12 is a side view of an alternative embodiment of the extractor and bolt end of the present invention.

Another embodiment of the extraction system of the present invention is shown in FIGS. 12 and 13. The extractor 70 shown for use with this embodiment is the trunnion design of FIGS. 1 through 3. However, it should be noted that any of the extractor designs shown herein or other extractors not discussed herein may be utilized with this embodiment.

In this embodiment, the bolt end 52 is provided with a chamfered edge 116 on the edge of the face 56, preferably opposite the location of the extractor 70. It should be noted that the chamfer 116 could extend around the entire periphery of the bolt end face 56, but it is preferable that the chamfer only extend around a portion of the face 56 because a larger face surface in the cavity 96 of the cartridge provides greater stability to the cartridge 90 in the event of a ruptured cartridge case. The chamfer 116 is configured and dimensioned at an angle which allows the lip 76 to slide under the flange 98 and into the cavity 96 of the cartridge before the chamfer 116 dissipates. Once the chamfer 116 has fully dissipated, the lip 76 will be engaged behind the flange 98 on the cartridge and the bolt end face 56 will be allowed to fully enter the cartridge cavity 96.

The bolt end 52 and extractor 70 may also include a recess 118 behind the lip 76 and on the upper portion of the bolt end 52. The recess is used to allow the flange 98 to enter the recess during extraction to allow the cartridge to rotate. This aids in proper ejection and allows the bottom of the bolt face to exit the cavity 96.

It should be noted that the chamfer and the recess may be used independently of each other. It should also be noted that, with this embodiment, the extractor 70 does not need to pivot to move past the flange 98. However, it is evident that all features may be used together.

Figure 14:
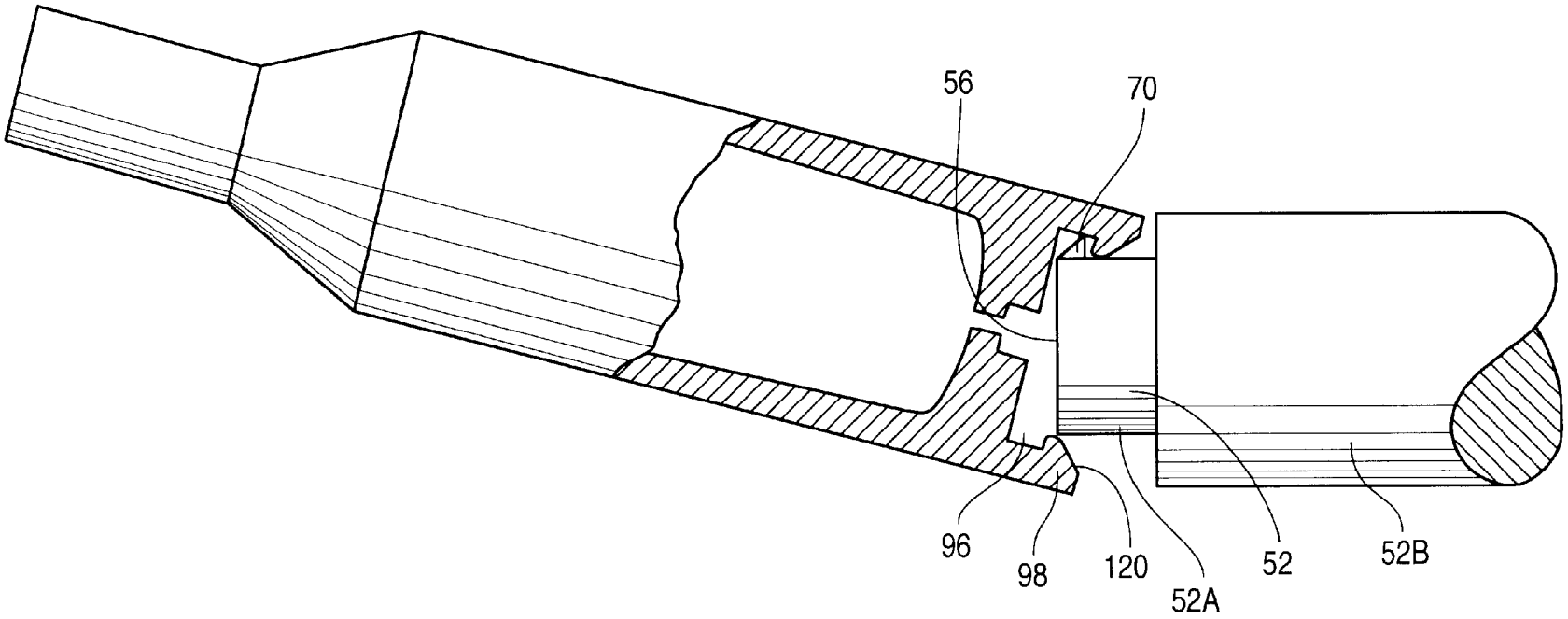
FIG. 14 is a partial cross-sectional view of a cartridge casing of the present invention with an extractor installed on a bolt end for internal extraction.

FIG. 14 shows another embodiment of the present invention. In FIG. 14, the chamfered or angled edge 120 is provided on the flange 98 instead of on the bolt end face 56, as shown in FIGS. 12 and 13. While the extractor 70 of the present invention may be used with this embodiment, it is not necessary. The angled edge is configured and dimensioned to allow the lip 76 to enter the cavity 96 as the bolt end 52 enters the cavity 96 in the cartridge.

Figure 16:
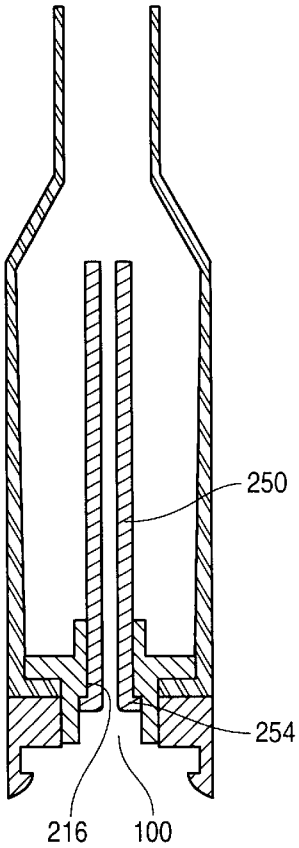
FIG. 16 is a cross-sectional view of another embodiment of the cartridge design of the present invention with a flash tube installed on the three part cartridge casing.
Figure 15:
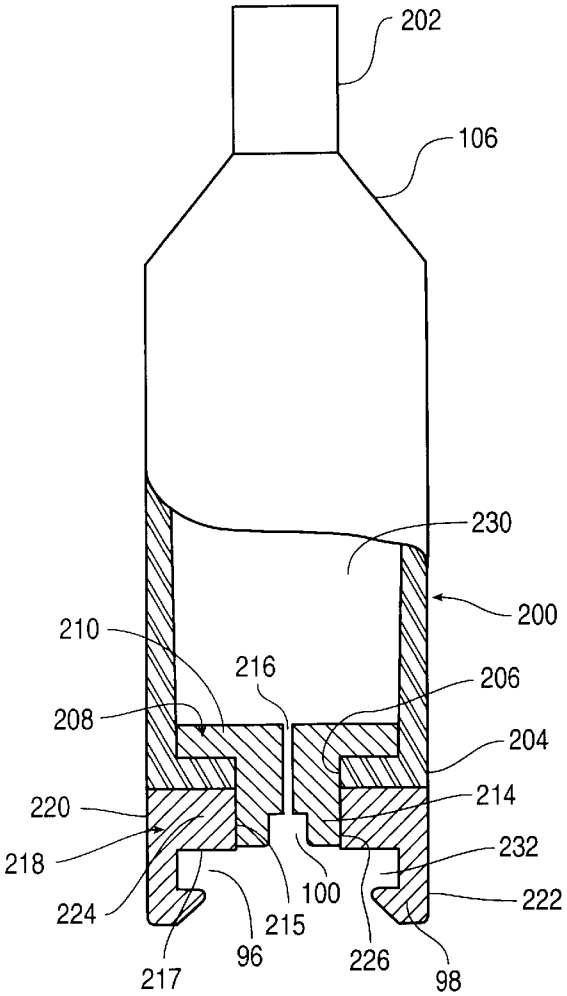
FIG. 15 is a cross-sectional view of another embodiment of the cartridge of the present invention where the cartridge casing is made of three parts.

Another aspect of the present invention is shown in FIGS. 15 and 16. FIG. 15 shows an improved cartridge design having three parts—a cylindrical member 200, a male cylindrical insert 208, and a female cylindrical insert 218.

The cylindrical insert has a first 202 and second end 204. The first end is for receiving a bullet and is preferably necked down 106. The second end defines a second end wall 204 which has a first aperture 206. An internal chamber 230 is defined between the first and second ends for storing gun powder 102 therein.

The male cylindrical insert is for placement within the internal chamber 230. The male insert has a first portion 210 for seating against an internal side of the second end wall 204. The male insert has a cylindrical extension 214 for placement within the first aperture 206 so that the extension extends into and past the outer side of the second end wall of the cylindrical member 200. A second aperture 216 is defined through the extension 214 of the male insert 208.

The female insert 218 has a first end 220 and a second end 222. The first end has a first end wall 224 with a third aperture 226 therethrough. The third aperture is for mating around the extension 214 of the male insert 208 and adjacent the outer side of the second end wall 204. The second end 222 of the female insert 218 has a cavity 96 with an inwardly extending flange 98 positioned at the outer edge of the cavity 96. A depression 232 is disposed behind the flange 98 in the cavity 96. The flange 98 preferably has an angled or curved edge which faces outward, although this is not required.

A primer cavity 100 for receiving a primer is preferably defined in the extension 214 of the male insert 208 and located at the extension end of the second aperture 216. The primer cavity 100 communicates with the internal chamber 230 through the second aperture 216. The primer may be ignited in a conventional manner such as by being struck by a firing pin (not shown). When the primer is ignited, a charge travels through the second aperture 216 to the internal chamber 230 to ignite the gun powder 102 in the internal chamber 230. When the gun powder 102 is ignited, the force of the explosion causes the bullet 104 to be forced out of the cartridge through the barrel 20. At the same time, the cartridge is forced away from the barrel 20 and its movement is blocked by the bolt 50. The extractor 70 is then used to remove the spent cartridge from the chamber 40 by engaging the extractor 70 behind the flange 98.

It is preferred that the flange 98 extend around the entire circumference of the female insert 218 in order to insure the effective operation of the extractor 70. It is also preferable that the flange 98 have at least one curved or angled edge located on a surface of the flange 98 which faces away from the cavity 96.

Further, it is preferable that the extension 214 of the male insert 208 includes a face 215 which substantially aligns with an inner side 217 of the first end wall 224 of the female insert 218. This is preferable because if a flush surface is presented, the bolt end face 56 can abut against the flush surface when the bolt end 52A enters the cavity 96 to further stabilize the cartridge during firing. The three-part cartridge is also advantageous in that, upon ignition of the gun powder in the cartridge, the pressure exerted on the cartridge by the explosion creates a tighter "press fit" of the members.

As shown in FIG. 16, flash tube 250 may be used with the three-part cartridge design by inserting the flash tube through the second aperture 216 within the primer cavity 100. The flash tube is used for transferring the primer burning material through the gun powder column to ignite the top surface of the powder in the cartridge, providing for burning the powder from the top down. The flash tube preferably has an outwardly extending flange 254 at a first end for proper seating within the primer cavity 100.

Figure 22:
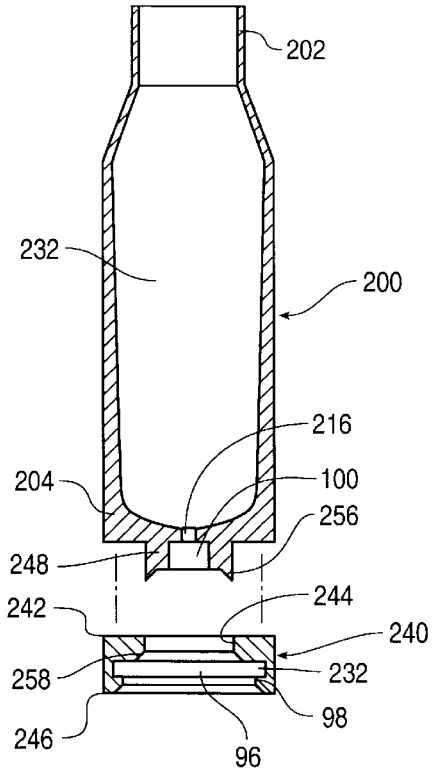
FIG. 22 is another embodiment of the cartridge of the present invention.

FIG. 22 shows an alternative cartridge design for use in a firearm 10 which includes a cylindrical member 200 and an insert 240. The cylindrical member has a first end 202 for receiving a bullet and a second end defining a second end wall 204. A second aperture 216 is disposed in the second end wall. The second end wall has an extension 248 for mating with the insert 240.

The extension preferably has disposed at one end of the second aperture a primer cavity 100 for receiving a primer. The internal chamber 232 of the cylindrical member is defined between the first and second ends and gun powder 102 is preferably stored in the internal chamber 232. The primer cavity 100 is connected to the internal chamber 232 via the second aperture 216 so that when the primer is ignited, the charge travels through the second aperture 216 to ignite the gun powder 102 in the internal chamber 232.

The insert 240 has a first end wall 242 with a first aperture 244 defined therein for engagement with the second end wall 204 of the cylindrical member 200. The second end of the insert defines a cavity 96 with an inwardly extending flange 98 around the circumference of the outer end of the cavity 96. The flange 98 has at least a portion with an inwardly angled surface. When the bolt end 52 and extractor 70 enter the cavity 96, the angled surface is at an angle sufficient to allow the extractor 70 to enter the cavity 96 behind the flange 98.

As further shown in FIG. 22, the cylindrical member extension 248 may include an outer angled flange 256 next to the primer cavity 100 and the insert 240 includes an angled portion 258 on the first end wall 242 so that a tool may be inserted into the cavity 96 to bend the flanges 256 outward to engage the angled portions 258 of the first end wall 242 of the insert 240. In this way member 200 and insert 240 may be secured to one another. It is also possible to press-fit the parts together or to braze or weld the parts together.

Figure 23:
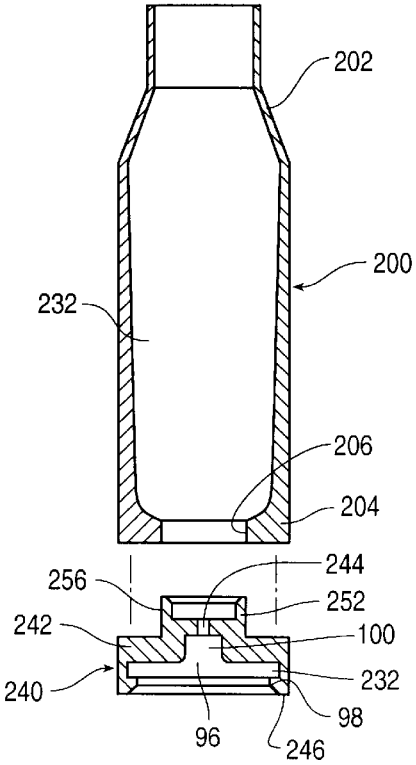
FIG. 23 is yet another embodiment of the cartridge of the present invention.

In another embodiment, shown in FIG. 23, the cylindrical member 200 has a first end 202 for receiving a bullet and a second end having a second end wall 204 with a first aperture 206. The insert includes an extension 252 for mating with the cylindrical member in the first aperture 206. The insert 240 has a cavity 96 at one end and a first end wall 242 at the other end. The first end wall 242 abuts with the second end wall 204 of the cylindrical member 200. The insert 240 includes a second aperture 244 defined through the first end wall 242.

The extension 252 of the insert 240 preferably has a flange 256 with angled portions. When the insert 240 is inserted into the first aperture 206, the flange 256 with angled portions may be bent outward to engage the inner surface of the second end wall 204 to secure the insert to the cylindrical member.

Figure 24:
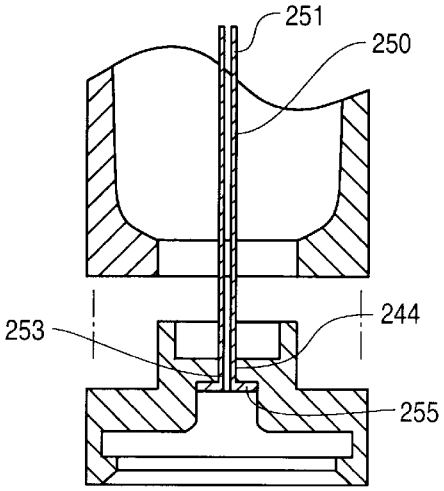
FIG. 24 is another embodiment of the cartridge of the present invention with a flash tube installed.

The extension 252 may also include a primer cavity 100. A flash tube 250 may be positioned within the primer cavity 100, as is shown in FIG. 24. The flash tube preferably has a first end 251 for inserting through the second aperture 244 of the insert 240 and a second end 253 with a flange 255.

In another aspect of the present invention, a method of manufacturing a cartridge case includes forming a cylindrical cartridge case section which defines a second end with a wall having a first aperture. A male insert, as shown in FIG. 15, is inserted into the cylindrical cartridge case section so that an extension of the male insert extends through and past an end of the first aperture. The male insert includes a second aperture defined through the extension. A female insert is then pressed onto the extension of the male insert which extends past the first aperture to mate the cartridge case section, the male insert, and the female insert together. The female insert has a cavity at one end and the female and male inserts preferably have flush engagements so that the inner surface of the cavity in the female insert is about planar.

The method preferably also includes forming a bullet mounting end on the first end of the cartridge case by necking the cartridge case inward. Gun powder may be disposed in the cartridge case. A bullet is preferably mounted in the first end of the cartridge case. The necked down portion of the cartridge is squeezed against the end of the bullet to provide a friction coupling therebetween. Primer is also preferably disposed in a cavity formed in the extension of the male insert at the end of the second aperture within the cavity of the female insert.

A flash tube insert may be pressed into the second aperture which is defined in the male insert. The flash tube insert has a first end defining an opening and a second end having an outwardly extending flange 254. A shoulder on the flange is used to position one end of the flash tube within the primer cavity and the second aperture. The parts of the cartridge may be brazed together in lieu of or in addition to press fitting.

Figure 17:
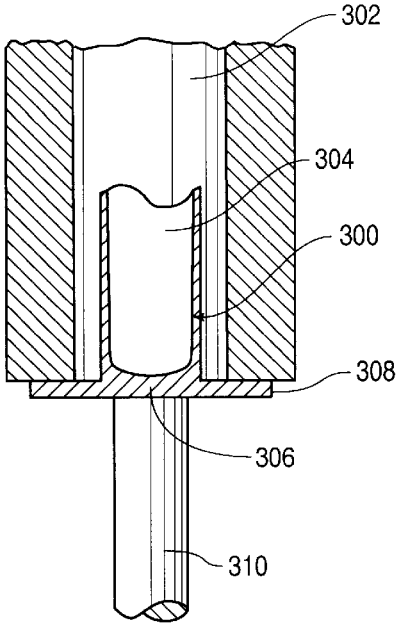
FIG. 17 is another aspect of the present invention showing the first step in a method of manufacturing a cartridge casing showing the cartridge blank installed in a female mandrel.
Figure 18:
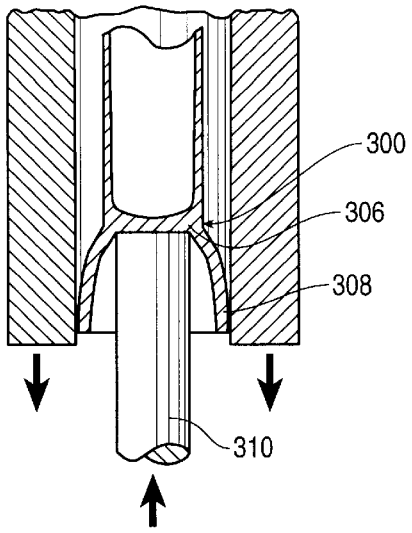
FIG. 18 shows another step in the method of making a cartridge casing where the cartridge blank is pressed into the female mandrel.
Figure 19:
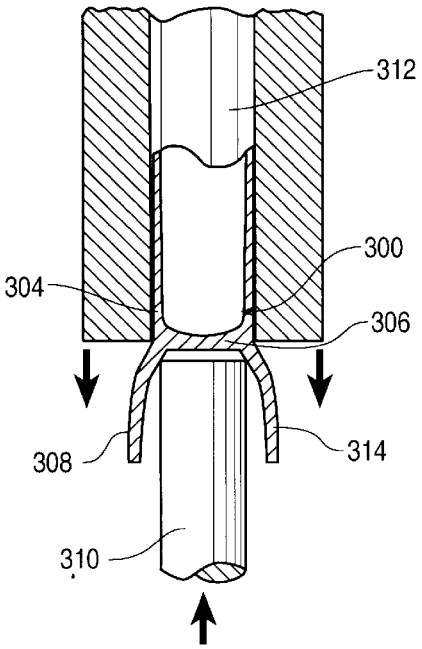
FIG. 19 shows another step in the method of making a cartridge casing where the cartridge casing is positioned for insertion into a smaller diameter female mandrel.
Figure 20:
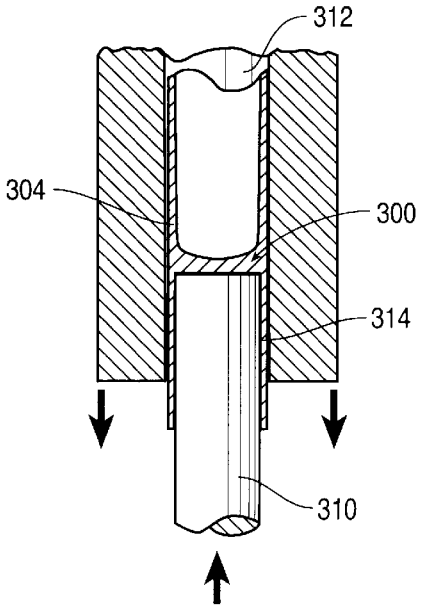
FIG. 20 shows another step in the method of making a cartridge casing where the cartridge casing is pressed into the smaller diameter female mandrel so that the external diameter of the casing is substantially uniform.

In another embodiment, the method of manufacturing a cartridge case is shown in FIGS. 17 through 21 and includes seating an open end of a tube 300 into a female mandrel opening 302. The tube is preferably made from brass. The tube has an open end 304 and a closed end 306. The closed end of the tube has an outwardly projecting flange 308 which extends beyond the opening 302 in the female mandrel, as shown in FIG. 17. A male mandrel 310, having a smaller diameter than the female mandrel, is then fitted against the closed end 306 of the tube and pressed into the female mandrel 302. The female mandrel may likewise be pressed onto the male mandrel 310 so that the forces of each mandrel interact. As the male mandrel 310 presses on the closed end 306 of the tube, the flange 308 is bent to form a skirt which fits in the female mandrel, as shown in FIG. 18.

The tube may then be inserted into a smaller diameter female mandrel 312 and the male mandrel 310 may then press the closed end 306 of the tube into the female mandrel 312 to bend and collapse the tube further so that the flange 308 forms a cylinder 314 which is substantially the same diameter as the tube 304.

The male mandrel has a diameter which is smaller than the smaller diameter female mandrel so that when the male mandrel presses the tube into the smaller diameter female mandrel, the outer diameter of the tube and cylinder are substantially the same.

Figure 21:
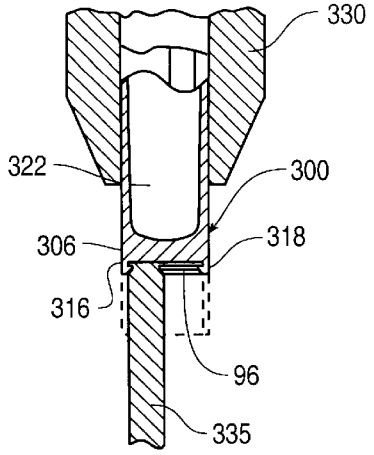
FIG. 21 shows another step in the method of making a cartridge casing where the casing is trimmed to form a cavity with an inwardly extending flange at one end.

After the cylinder 314 has been formed from the flange 308, a groove 316 may be formed around an inner surface of the cylinder, as shown in FIG. 21, while the tube is held in a chuck 330. The groove 316 is formed at a distance from the end of the cylinder so that when the cylinder is trimmed, a flange 318 remains at the edge of a cavity 96 formed by the cylinder. The groove 316 is preferably defined beside a flange 318 within the cavity 96. The chuck 330 holds the tube open end and the lower end of the skirt 314 is sheared transversely, shown in broken lines, leaving a short outstanding flange 318. A cutting tool 335 is turned around the inner wall of the flange 318 to cut the groove 316. The flange may be finished with an inwardly sloping surface.

A primer cavity 100 may also be formed in the closed end 306 of the tube for receiving a primer. An aperture (not shown) may be formed at the end of the primer cavity (not shown) through the closed end wall 306 to communicate with an interior portion 322 of the tube. An inwardly necked portion (not shown) is preferably formed in the open end 304 of the tube for receiving a bullet. This may be formed by a conventional drawing procedure by pulling the tube through a reducing collar (not shown). A flash tube may be fitted into the primer cavity and through the aperture so that the flash tube extends into the interior of the tube. Gun powder may be disposed in the interior of the tube and primer may be disposed in the primer cavity.

It should be noted that the female mandrel 302, 312 may be pressed onto the male mandrel 310 and the male mandrel 310 may be pressed into the female mandrel 302, 312 or vice versa. It should also be noted that, while two pressing steps are shown in FIGS. 17 through 21, more than two pressing stages may be used to create the cartridge or only one pressing stage may be used. The number of stages necessary will be dependent upon the type of material used, the strength and/or hardness of the material used, and the size of the cartridge.

Figure 25:
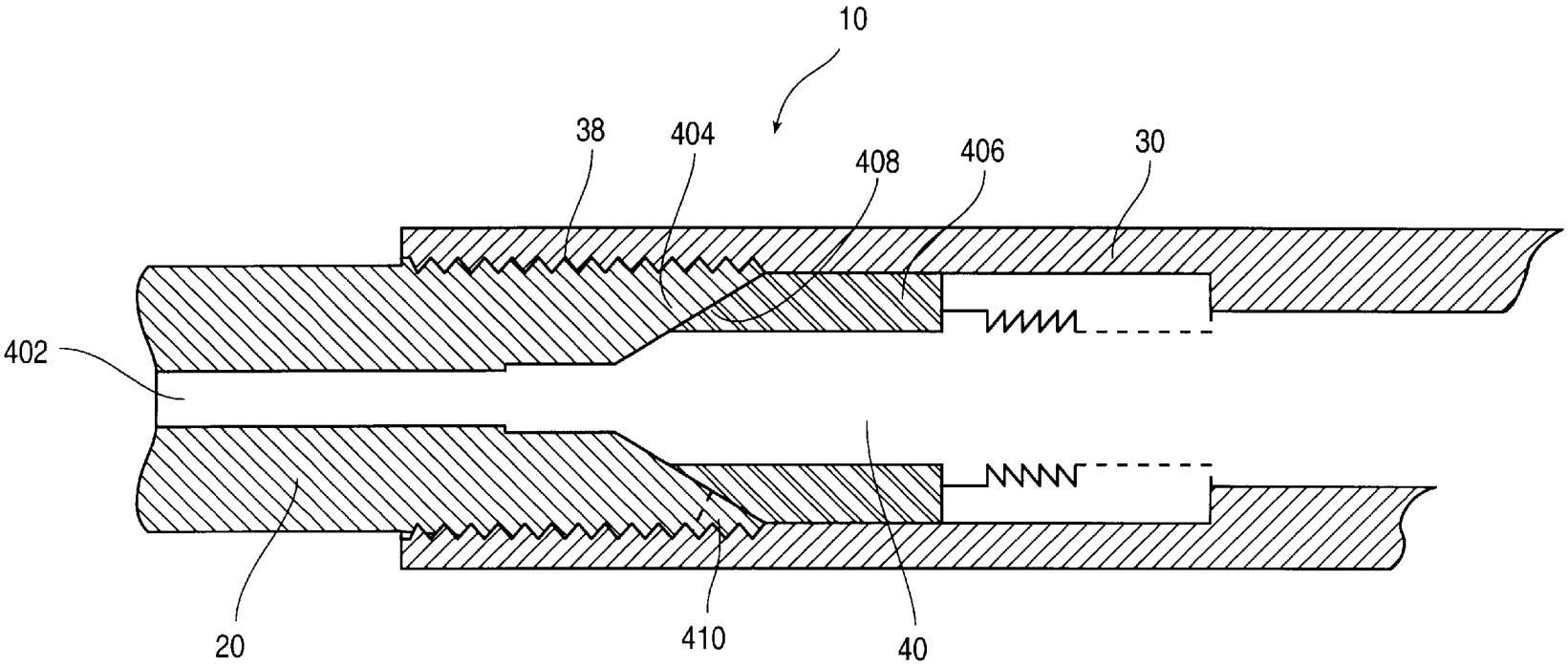
FIG. 25 is another aspect of the present invention showing a receiver reinforced by an insert with an angled front edge.

Another aspect of the present invention is shown in FIG. 25. FIG. 25 shows a chamber 40 of a firearm 10 for receiving ammunition. At one end of the chamber, a barrel 20 extends with a longitudinal bore 402. A bolt 50 may be positioned in the other end of the chamber 40, but is not shown. The outer walls of the chamber are formed by the receiver 30, which engages the barrel with connecting means 38 such as threads or bayonet mounts. In this embodiment of the present invention, the barrel 20 has an inwardly angled edge 404 adjacent the chamber 40. The chamber also includes an insert 406 which is preferably "press fit", welded, or brazed to the receiver to form the outer edges of the chamber 40. The insert 406 has an angled edge 408 for abutting the inwardly angled edge 404 of the barrel 20. The angled edges are at substantially the same angle so that they meet to form a tight fit.

Known receivers and barrels, as shown in FIG. 1, have used a precision fit where the end of the barrel 20 and the receiver 30 must be precisely milled to fit together snugly. As shown in FIG. 1, the barrel portion 20 which connects to the receiver 30 must be a precise length for meeting the inner edge of the receiver when the barrel is screwed onto the receiver. If the fit is not precise, leaving a gap, a dangerous firearm is created since the chamber of the gun is weakened. As a result, the likelihood of an explosion within the chamber breaching the barrel or receiver is increased. This precision fitting is expensive and time consuming.

The receiver insert 406 and barrel design of the present invention alleviates the need to precisely fit the pieces of the barrel 20 and receiver 30 together. For instance, if the barrel 20 is too short or is shortened due to wear, the insert 406 will continue to match with the angled surface 404. Even if a gap 410 is present (as shown in phantom in FIG. 25) due to an imprecisely cut barrel 20, the chamber 40 will continue to maintain its integrity since at least a portion of the connection between the barrel 20 and the insert 406 will be maintained.

It should be understood that variations and modifications within the spirit and scope of the invention may occur to those skilled in the art to which the invention pertains. Accordingly, all expedient modifications readily attainable by one versed in the art from the disclosure set forth herein that are within the scope and spirit of the present invention are to be included as further embodiments of the present invention. The scope of the present invention accordingly is to be defined as set forth in the appended claims.

What is claimed is:

1. A cartridge for a firearm having a barrel, a bolt member having a bolt end for positioning an extractor member thereon, and a chamber defined between the barrel and the bolt, which comprises:

a cylindrical member having a first end for receiving a bullet and a second end defining a second end wall having a first aperture, said member being dimensioned and configured for positioning within the chamber;

a male cylindrical insert for positioning within the cylindrical member, said male insert having a first portion for seating against an internal side of the second end wall and a cylindrical extension for positioning in and extending through the first aperture, said extension defining a second aperture therethrough; and a female cylindrical insert having a first end and a second end, said first end defining a first end wall with a third aperture for mating with the extension of the male insert so that the first end wall of the female insert is associated with an external side of the second end wall of the cylindrical member, said female insert second end having a cavity configured and dimensioned for receiving the bolt end and the extractor member.

2. The cartridge of claim 1, which further comprises:

a primer cavity for receiving a primer defined in the extension of the male insert and located at an end of the second aperture.

3. The cartridge of claim 2, which further comprises:

an internal chamber defined between the male insert and the first end of the cylindrical member for receiving a column of gun powder, said internal chamber communicating with the primer cavity via the second aperture, wherein when the primer is ignited, a charge travels through the second aperture to ignite gun powder in the internal chamber.

4. The cartridge of claim 1, wherein the cylindrical female insert includes an inwardly extending flange positioned at the second end of the female insert adjacent the cavity.

5. The cartridge of claim 4, wherein the inwardly extending flange extends around substantially the entire circumference of the cavity.

6. The cartridge of claim 5, wherein the flange has at least one angled or curved edge.

7. The cartridge of claim 6, wherein the at least one angled or curved edge is located on a surface of the flange which faces away from the cavity.

8. The cartridge of claim 1, wherein the extension of the male insert includes a face which substantially aligns with an inner side of the first end wall of the female insert.

9. A cartridge for a firearm having a barrel member, a bolt member with a bolt end for positioning an extractor member thereon, and a chamber between the barrel member and the bolt member, which comprises:

a cylindrical member having a first end for receiving a bullet and a second end defining a second end wall; and an insert having a first end wall and a second end defining a cavity with an inwardly extending flange around the circumference of an outer end of the cavity, said flange having at least a portion with an inwardly angled surface, with said inwardly angled surface being at an angle which is less than 90°, said cylindrical member second end wall being configured and dimensioned for engagement with the first end wall of the insert;

wherein when a bolt end and an extractor member enter the cavity, the angled surface is at an angle sufficient to allow an extractor member to engage the cavity behind the flange.

10. A cartridge for a firearm having a barrel member, a bolt member with a bolt end for positioning an extractor member thereon, and a chamber between the barrel member and the bolt member, which comprises:

a cylindrical member having a first end for receiving a bullet and a second end defining a second end wall; and an insert having a first end wall and a second end defining a cavity with an inwardly extending flange around the circumference of an outer end of the cavity, said flange having at least a portion with an inwardly angled surface, said cylindrical member second end wall being configured and dimensioned for engagement with the first end wall of the insert;

wherein when a bolt end and an extractor member enter the cavity, the angled surface is at an angle sufficient to allow an extractor member to engage the cavity behind the flange and the cylindrical member includes a member extension extending outward from the second end wall with a second aperture extending therethrough and the insert includes a first aperture so that the member extension mates with the first aperture of the insert to connect the cylindrical member to the insert.

11. The cartridge of claim 10, wherein the member extension includes a primer cavity which is positioned at one end of the second aperture for receiving a primer.

12. The cartridge of claim 11, which further comprises:

an internal chamber defined between the second end wall and the first end of the cylindrical member for receiving a column of gun powder, said internal chamber communicating with the primer cavity via the second aperture, wherein when the primer is ignited, a charge travels through the second aperture to ignite the gun powder.

13. The cartridge of claim 12, which further includes a flash tube having a first end and a second end with a flange extending outwardly at the second end of the flash tube, said second end of said flash tube being configured and dimensioned for positioning within the primer cavity and said first end of the flash tube extending through the second aperture into the internal chamber for passing the primer charge to the top of the column of gun powder.

14. A cartridge for a firearm having a barrel member, a bolt member with a bolt end for positioning an extractor member thereon, and a chamber between the barrel member and the bolt member, which comprises:

a cylindrical member having a first end for receiving a bullet and a second end defining a second end wall having a second aperture, and including a flange portion associated with the second end of the cylindrical member and defining a cavity with an inwardly extending flange around the circumference of the flange portion of an outer end of the cavity, said flange having an inwardly angled surface, said inwardly angled surface being at an angle which is less than 90°;

wherein when the bolt end and said extractor member enter the cavity, the angled surface of the flange is at an angle sufficient to allow said extractor member to engage the cavity behind the flange.

15. The cartridge of claim 14, wherein the flange portion is integral with the cylindrical member.

16. The cartridge of claim 14, wherein the flange portion is an insert.

17. A cartridge for a firearm having a barrel member, a bolt member with a bolt end for positioning an extractor member thereon, and a chamber between the barrel member and the bolt member, which comprises:

a cylindrical member having a first end for receiving a bullet and a second end defining a second end wall having a second aperture, and including a flange portion associated with the second end of the cylindrical member and defining a cavity with an inwardly extending flange around the circumference of the flange portion of an outer end of the cavity, said flange having an inwardly angled surface;

wherein when the bolt end and said extractor member enter the cavity, the angled surface of the flange is at an angle sufficient to allow said extractor member to engage the cavity behind the flange and the cylindrical member includes a member extension extending outwardly from the cylindrical member second end wall with the second aperture extending therethrough and said insert flange portion mates with the member extension to connect the cylindrical member to the insert flange portion.

18. The cartridge of claim 17, wherein said member extension includes a primer cavity positioned at one end of the second aperture for receiving a primer and further comprising a flash tube having a first end and a second end with a flash tube flange extending outwardly at the flash tube second end, said flash tube second end being configured and dimensioned for positioning within the primer cavity and said flash tube first end extending through the second aperture into the cylindrical member.

19. A cartridge for a firearm having a barrel member, a bolt member with a bolt end for positioning an extractor member thereon, and a chamber between the barrel member and the bolt member, which comprises:

a cylindrical member having a first end for receiving a bullet and a second end defining a second end wall having a second aperture, and including a flange portion associated with the second end of the cylindrical member and defining a cavity with an inwardly extending flange around the circumference of the flange portion of an outer end of the cavity, said flange having an inwardly angled surface;

wherein when the bolt end and said extractor member enter the cavity, the angled surface of the flange is at an angle sufficient to allow said extractor member to engage the cavity behind the flange and the flange portion comprises a male cylindrical insert and a female cylindrical insert, said male cylindrical insert for positioning within the cylindrical member and having a male insert first portion for association with the cylindrical member second end wall and a male insert extension extending through a first aperture defined in the second end wall of the cylindrical member, said male cylindrical insert including the second aperture defined therethrough, and said female cylindrical insert having a female insert first end defining a female insert first end wall having a third aperture defined therethrough and a female insert second end, said female cylindrical insert third aperture for association with said male insert extension so that the first end wall of the female insert is positioned adjacent said cylindrical member second end wall, said female insert second end defining the cavity and inwardly extending flange.

20. The cartridge of claim 19, wherein the male cylindrical insert includes a primer cavity which is positioned at one end of the second aperture for receiving a primer.

* * * * *